US009091053B2

(12) United States Patent
Labonte et al.

(10) Patent No.: US 9,091,053 B2
(45) Date of Patent: Jul. 28, 2015

(54) CLIP ASSEMBLY FOR USE WITH A SUSPENDED CEILING

(75) Inventors: Patrick Labonte, Laval (CA); André St-Laurent, Laval (CA)

(73) Assignee: EMBASSY CEILING INC., Laval, Quebec (CA)

( * ) Notice: Subject to any disclaimer, the term of this patent is extended or adjusted under 35 U.S.C. 154(b) by 0 days.

(21) Appl. No.: 13/255,290

(22) PCT Filed: Mar. 10, 2010

(86) PCT No.: PCT/CA2010/000326

§ 371 (c)(1), (2), (4) Date: Nov. 17, 2011

(87) PCT Pub. No.: WO2010/102388

PCT Pub. Date: Sep. 16, 2010

(65) Prior Publication Data

US 2012/0055109 A1 Mar. 8, 2012

Related U.S. Application Data

(60) Provisional application No. 61/202,530, filed on Mar. 10, 2009.

(51) Int. Cl.
*E04B 9/22* (2006.01)
*E04B 9/28* (2006.01)

(52) U.S. Cl.
CPC .... *E04B 9/28* (2013.01); *E04B 9/22* (2013.01)

(58) Field of Classification Search
CPC ..... E04B 9/00; E04B 9/005; E04B 9/006; E04B 9/10; E04B 9/18; E04B 9/183; E04B 9/20; E04B 9/205; E04B 9/22; E04B 9/225; E04B 9/24; E04B 9/26; E04B 9/28; E04B 9/34; E04B 9/36; E04C 3/02; E04C 2003/026
USPC ..... 52/204.59, 506.01, 506.04, 52/506.06–506.09, 511
See application file for complete search history.

(56) References Cited

U.S. PATENT DOCUMENTS

| | | | | |
|---|---|---|---|---|
| 1,818,299 | A * | 8/1931 | Bowman | 52/335 |
| 2,276,788 | A * | 3/1942 | Norris | 454/296 |
| 2,841,255 | A * | 7/1958 | Kemp | 52/395 |
| 3,360,896 | A * | 1/1968 | Wright | 52/506.09 |
| 3,390,856 | A * | 7/1968 | Buren, Jr. | 248/317 |
| 3,612,461 | A * | 10/1971 | Brown | 248/317 |
| 3,671,061 | A * | 6/1972 | Dawdy | 52/511 |

(Continued)

FOREIGN PATENT DOCUMENTS

| | | |
|---|---|---|
| CA | 2 588 300 A1 | 10/2008 |
| EP | 0 681 069 A1 | 11/1995 |

OTHER PUBLICATIONS

International Search Report: mailed Jul. 12, 2010; PCT/CA2010/000326.

*Primary Examiner* — Joshua J Michener
*Assistant Examiner* — Theodore Adamos
(74) *Attorney, Agent, or Firm* — Equinox IP; Franz Bonsang

(57) ABSTRACT

A clip assembly for use with a suspended ceiling comprises a first member secured to an overhead structural member and a second member connected to a runner supporting ceiling tiles the first and second members being adapted to be connected together such that the runner can be suspended from the structural member via the clip assembly.

4 Claims, 15 Drawing Sheets

(56) References Cited

U.S. PATENT DOCUMENTS

| | | | | | |
|---|---|---|---|---|---|
| 3,708,941 | A | * | 1/1973 | Cuckson | 52/506.08 |
| 3,936,990 | A | * | 2/1976 | Garrison et al. | 52/718.01 |
| 3,950,916 | A | * | 4/1976 | Kasprzak | 52/750 |
| 3,969,865 | A | * | 7/1976 | Andersen | 52/506.07 |
| 4,067,155 | A | * | 1/1978 | Ruff et al. | 52/105 |
| 4,452,021 | A | * | 6/1984 | Anderson | 52/506.07 |
| 4,614,072 | A | * | 9/1986 | Price et al. | 52/506.08 |
| 4,722,161 | A | * | 2/1988 | Young | 52/506.07 |
| 4,742,662 | A | * | 5/1988 | Smith | 52/718.01 |
| 4,926,606 | A | * | 5/1990 | Hanson | 52/506.07 |
| 5,077,951 | A | | 1/1992 | Baker | |
| 5,611,185 | A | * | 3/1997 | Wilz | 52/506.07 |
| 5,845,447 | A | * | 12/1998 | Bodine et al. | 52/506.09 |
| 6,047,517 | A | * | 4/2000 | Vrame | 52/506.06 |
| 6,205,732 | B1 | * | 3/2001 | Rebman | 52/506.07 |
| 6,205,733 | B1 | * | 3/2001 | LaLonde | 52/506.07 |
| 6,230,464 | B1 | * | 5/2001 | Vrame | 52/506.08 |
| 7,392,629 | B1 | * | 7/2008 | Bankston et al. | 52/506.07 |
| 7,562,504 | B2 | * | 7/2009 | Herbst et al. | 52/461 |
| 7,634,881 | B2 | * | 12/2009 | Ahren et al. | 52/506.06 |
| 7,658,047 | B2 | * | 2/2010 | Bankston et al. | 52/506.07 |

* cited by examiner

CLIP ASSEMBLY FOR USE WITH A SUSPENDED CEILING

CROSS-REFERENCE TO RELATED APPLICATIONS

The present application claims the benefits of U.S. provisional patent application No. 61/202,530 filed Mar. 10, 2009, entitled SUSPENDED CEILING, which is hereby incorporated by reference.

FIELD OF THE INVENTION

The present invention relates to ceilings and more precisely to suspended ceilings. The invention more precisely relates to a kit of parts adapted to be assembled to form a ceiling.

BACKGROUND OF THE INVENTION

Suspended ceilings are usually made of a metal grid consisting of longitudinal parallel runners spaced apart from one another a desired distance and separated by cross members in a perpendicular fashion thereby creating a plurality of rectangular openings. In general, those rectangular openings are of standard sizes allowing the ventilation outlets and the lighting fixtures to be easily inserted among the ceiling panels.

Suspended ceilings have been mostly utilized in office buildings and in housing basements because of the handiness that such systems allow to repair and/or to modify the partition of the space. However, most development in suspended ceilings has been towards improving the convenience for offices, without any improvement to the visual aspect of the ceiling.

Indeed, the typical ceiling panels are made of fibrous material with a flat bottom finish, which are inserted in the rectangular openings made of the metal grid as disclosed in U.S. Pat. No. 2,971,617, No. 3,385,021 and No. 3,785,110. Such unappealing designs have restricted the installation of suspended ceilings in residential construction to the basement and hinder their distribution whenever an upscale finish is desired.

To improve the appearance of the conventional suspended ceilings, wooden or wood-like grid systems have been reported in U.S. Pat. Nos. 3,583,119, 3,557,506, 4,454,700, 4,281,498, 4,367,616, 4,452,021, 4,464,876, 4,525,971, 4,773,200, 5,218,808, and 7,010,895. Installation of such ceiling systems usually required additional manipulations and was used in conjunction with the conventional flat bottom fiberboard panels Therefore, a need has been found for an improved suspended ceiling. Similarly, a need has arisen for an improved suspended ceiling that is inexpensive to produce and easy to install.

SUMMARY OF THE INVENTION

An aspect of the present invention provides an improved modular ceiling over known suspended ceilings.

This invention relates to an easy-to-install suspended ceiling system and more specifically to the MDF composition of the panel, runners and cross members, which procure an aesthetical look.

A clip assembly, a stabilizing system and a wall fastener are proposed for erecting the suspended ceiling in different environments.

One aspect of the present invention provides a clip assembly for use with a suspended ceiling, comprising a first member adapted to be secured to an overhead structural member and a second member adapted to be connected to a runner adapted to support a ceiling tile or the like, the first and second members being adapted to be connected together such that the runner can be suspended from the structural member via the clip assembly.

Another aspect of the present invention provides the first member with a downwardly facing channel and the second member with a protrusion adapted to connectingly engage the channel.

A further aspect of the present invention provides the first member with a pair of downwardly flaring arms adapted to guide the protrusion into the channel, the first and second members being adapted to be connected in a direction perpendicular to the axis of the first member.

Another aspect of the present invention provides the first member with a pair of shoulders provided at a junction of the downwardly flaring arms and the channel, and the protrusion with at least two spaced apart sets of fins adapted for selective adjustment of the relative assembled position of the first and second members.

Yet another aspect of the present invention provides a stabilizer for use with a suspended ceiling, comprising an elongated member adapted to engage at opposed ends thereof a pair of support members adapted to be connected to substantially parallel runners adapted to support a ceiling tile or the like, whereby the elongated member substantially prevents swaying of the runners relative to one another.

Another aspect of the present invention provides an assembly clip spacing gauge for use in installing assembly clips, comprising an elongated member adapted to engage at opposed ends thereof a pair of assembly clips at a given or selectable spacing.

BRIEF DESCRIPTION OF THE DRAWINGS

The features of the invention will become more apparent in the following detailed description in which reference is made to the appended drawings wherein.

DESCRIPTION OF ILLUSTRATIVE EMBODIMENTS OF THE INVENTION

The preferred embodiment illustrated in the Figures is one possible mechanical arrangement among other workable variations. These other workable variations are not considered to be enough materially distinctive so that a person skilled in the art of ceiling manufacturing and installation would not know how to adapt the present invention thereto.

Figure 1:
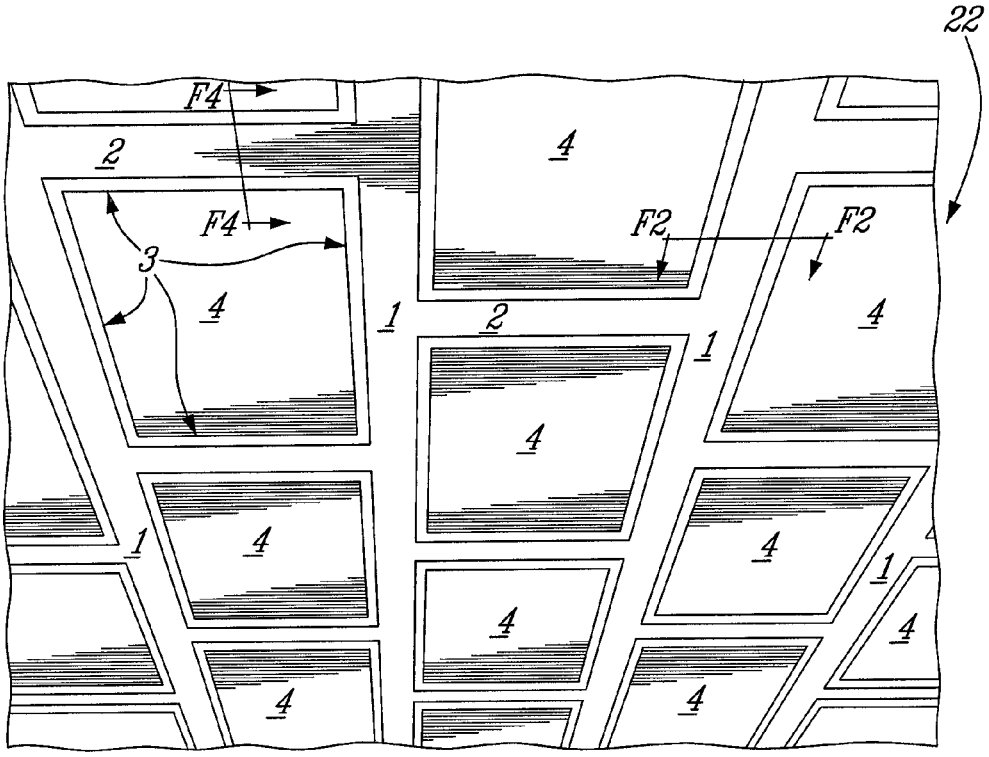
FIG. 1 is a perspective bottom view of the suspended ceiling of the present invention, wherein the plurality of runners and cross members gives rise to a lattice defining openings that can accommodate the profiled panels as well as the ventilation outlets and the lighting fixtures, if required.
Figure 2:
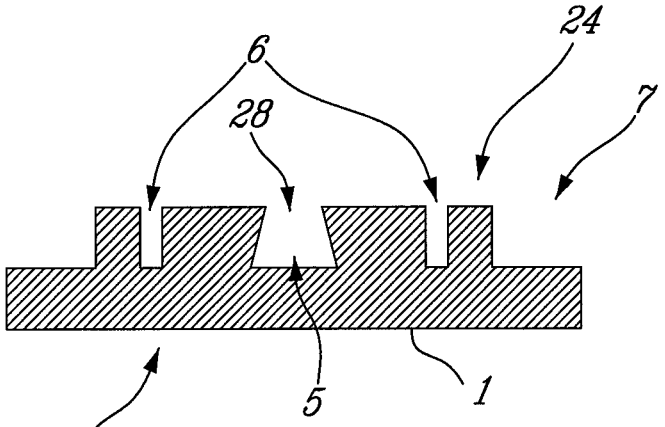
FIG. 2 is a cross sectional view of a runner.

FIG. 1 illustrates a suspended ceiling 22 built with a series of main runners 1 and cross members 2 in a lattice pattern. The surface covered by the modular ceiling 22 and the distance between main runners 1 and cross members 2 can also vary in accordance with the desired visual effect. On FIG. 1 the cross members 2 are illustratively alternated on each side of the main runners 1 but they could also be aligned. Panels 4 are installed in the openings formed by the lattice of main runners 1 and cross members 2.

Figure 3:
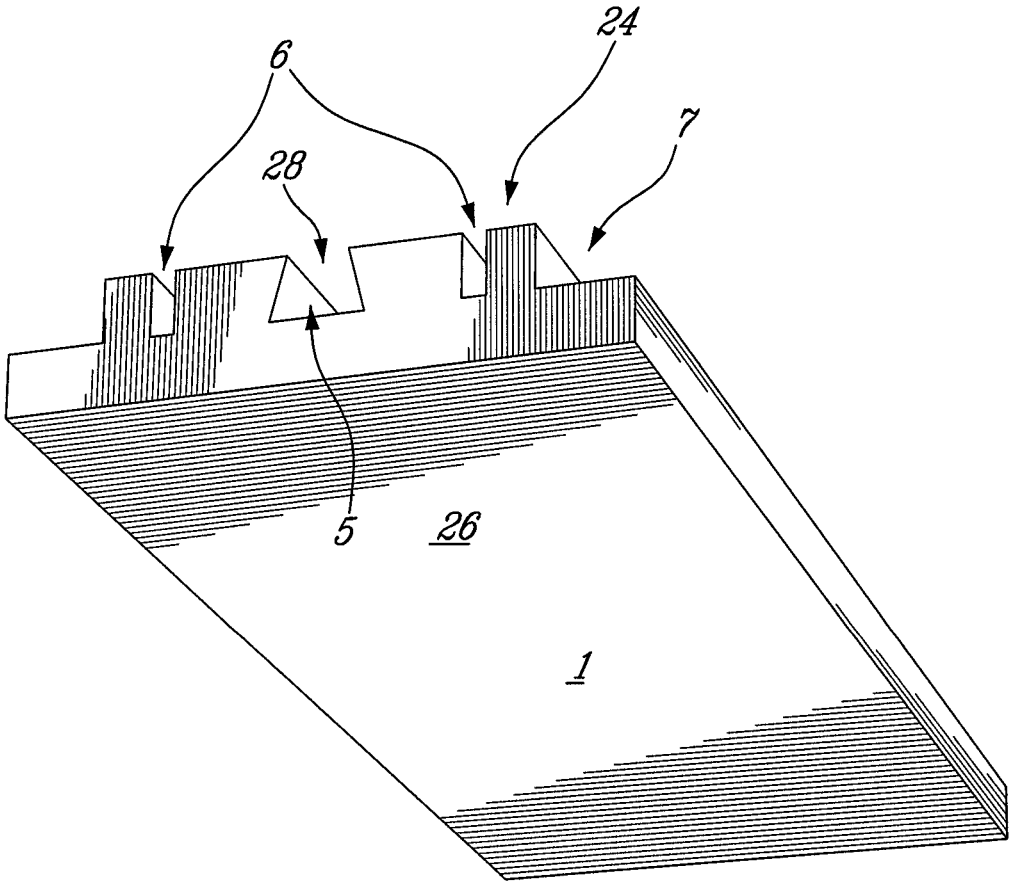
FIG. 3 is a three dimensional view of the runner of FIG. 2.
Figure 4:
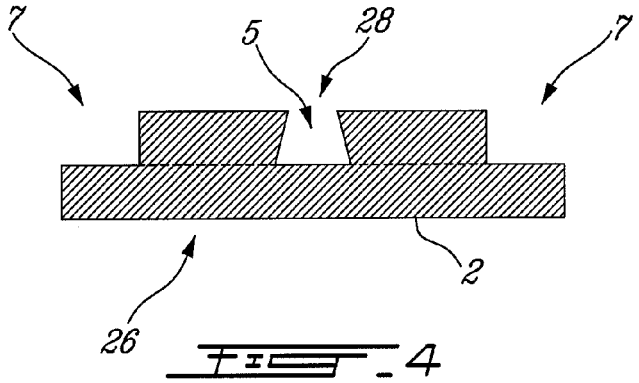
FIG. 4 is a cross sectional view of a cross member.

Referring to FIG. 3 and FIG. 4 it is appreciated that the main runner 1 has an upper surface 24 facing the upper side of the room and a lower surface 26 facing the floor of the room in which the ceiling 22 is installed. The upper surface 24 comprises a longitudinal retaining cavity 5 preferably disposed in the center of the main runner 1. The longitudinal retaining cavity 5 is adapted to receive a fastener to suspend the main runners 1. The longitudinal retaining cavity 5 is preferably shaped to receive a fastener 36 having a dovetail shape 28 to easily secure the fastener 36 in the longitudinal retaining cavity 5. The dovetail shape 28 allows a strong and safe connection with the associated longitudinal retaining cavity 5.

The upper surface 24 also comprises two grooves 6 respectively disposed on each side of the longitudinal retaining cavity 5. The longitudinal retaining cavities 5 are adapted to position and secure the cross members 2 to the main runners 1. The fastening mechanism will be detailed later in the description.

Additionally the upper surface 24 defines two lips 7 disposed on each side of the upper surface 24 to receive and support the cooperating edge of the panel 4.

The longitudinal retaining cavity 5, the two grooves 6 and the lips 7 can be produced with the main runner 1 using an extrusion process given the main runner 1 can be made of plastic or aluminum. The longitudinal retaining cavity 5, the two grooves 6 and the lips 7 can alternatively be manufactured by adding portions of material on top of the bottom portion of the main runner 1 that is a rectangle. The additional portions of material can be glued or hot-welded depending on the process that is used.

The size of the main runner 1 is compact with its ~75 mm width to keep to a minimum the thickness so that the space needed above the main runner 1 is reduced to maximize the height of the room in which the ceiling is installed.

Figure 5:
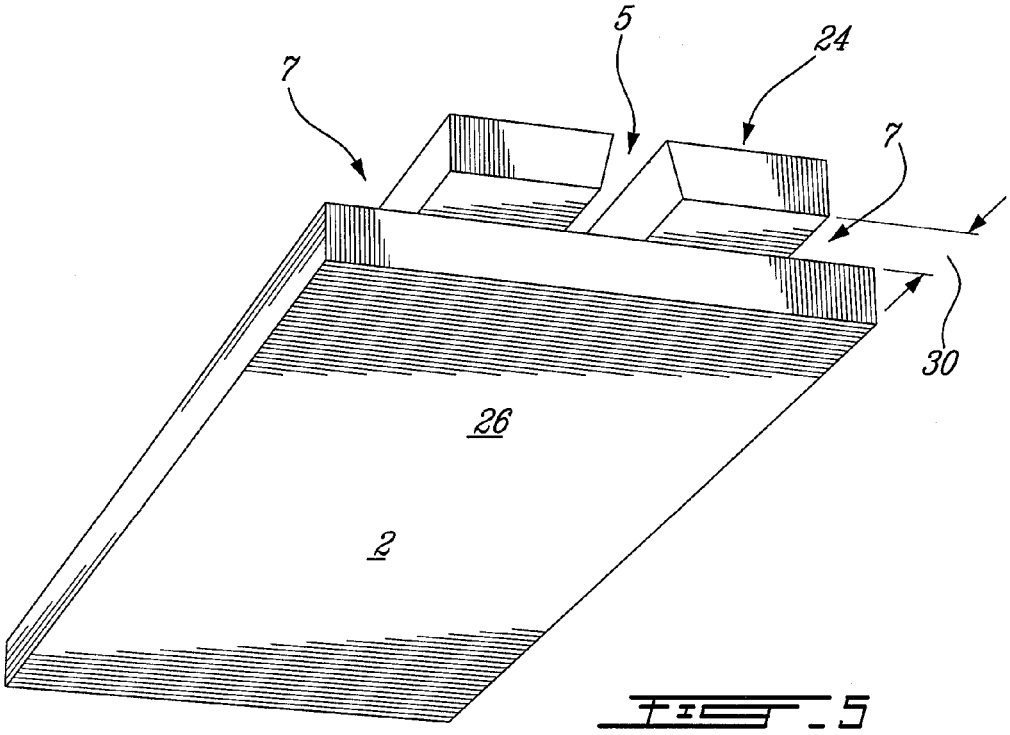
FIG. 5 is a three dimensional view of the cross member of FIG. 4.

FIGS. 4 and 5 illustrate the cross member 2 in isolation. It can be appreciated that the cross member 2 also has an upper surface 24 and a lower surface 26. A longitudinal retaining cavity 5 and two lips 7 are also provided in the upper surface 24 of the cross member 2. A longitudinal extension 30 is provided at each end of the cross member 2. The longitudinal extension 30 is adapted to mate with the lip 7 of the main runner 1 thus providing support to the cross member 2. The same materials and manufacturing processes used for manufacturing the main runners 1 are suitable to manufacture the cross members 2.

Figure 6:
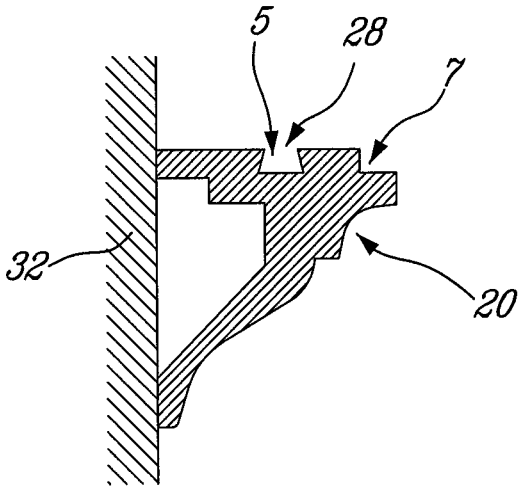
FIG. 6 is a cross sectional view of an optional ogee runner adapted for installation in the periphery of the lattice along the wall.

An ogee 20 is depicted on FIG. 6. The ogee 20 is a support member just as the main runner 1 and the cross member 2 with the difference that it is used where the ceiling 22 reaches a wall 32. The ogee 20 comprises a longitudinal retaining cavity 5 and a lip 7 that are similar to the above-described longitudinal retaining cavity 5 and lip 7 for the main runner 1 and the cross member 2. The ogee 20 is secured to the wall with fasteners (i.e. nails, screws, . . . ), the fastener 36 using the longitudinal retaining cavity 5 or glued at the right height so that the ogee 20 can receive and support the adjacent cross members 2 and panels 4. The ogee 20 is manufacturable with similar materials and processes as the main runners 1.

Figure 7:
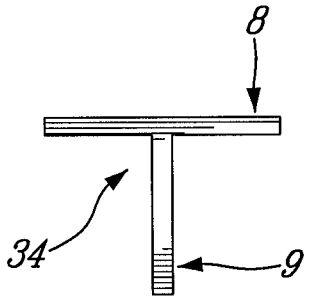
FIG. 7 is a cross sectional view of a ceiling anchor.
Figure 8:
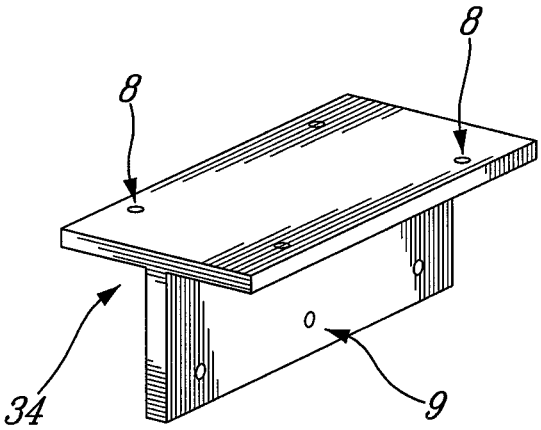
FIG. 8 is a three dimensional view of the ceiling anchor of FIG. 7.

FIG. 7 and FIG. 8 illustrate an illustrative cooperating part to the fastener used to suspend the main runner 1 and the cross member 2 by their longitudinal retaining cavity 5. The cooperative part shown on FIGS. 7 and 8 is a T-shaped support 34 adapted to be secured with the holes in a horizontal portion 8 of the T-shaped support 34 to a trust, an above-ceiling structure 38 and also connects to the fastener 36. The T-shaped support 34 permits height adjustment by securing the corresponding fastener 36 at the right position with the holes 9 present in the vertical portion of the T-shaped support 34.

Figure 9:
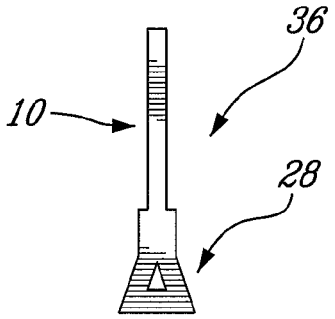
FIG. 9 is a cross sectional view of a dovetail runner anchor that is inserted into the runner dovetail groove.
Figure 10:
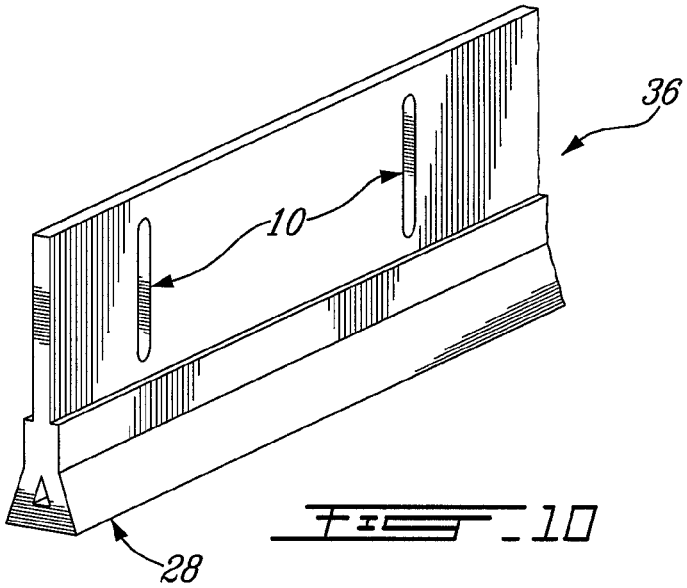
FIG. 10 is a three dimensional view of the dovetail runner anchor of FIG. 9.
Figure 11:
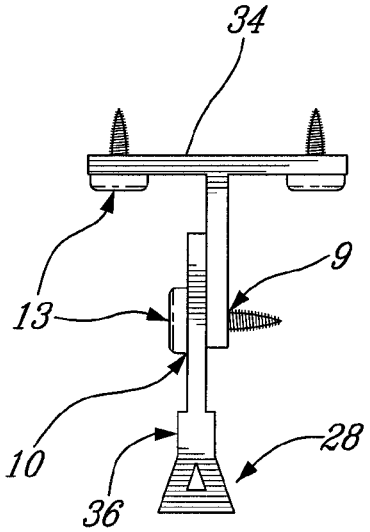
FIG. 11 is a cross sectional view of the assembly of the dovetail runner anchor to the ceiling anchor of FIGS. 7 and 9.

One can appreciate from FIG. 9 and FIG. 10 that the fastener 36 defines a shape adapted to cooperate with the longitudinal retaining cavity 5. In the present situation the shape provided by the fastener 36 is the male dovetail shape 28 adapted to cooperate with the female counterpart that is the properly shaped longitudinal retaining cavity 5. The fastener 36 defines a vertical section having a plurality of slots 10 adapted to receive a fastener to be secured to an associated connection member 34 (in the present situation, the T-shaped support 34) with a bolt or a screw 13 as shown on FIG. 11. The fastener 36 can be produced in plastic or aluminum with a proper extrusion process.

Figure 12:
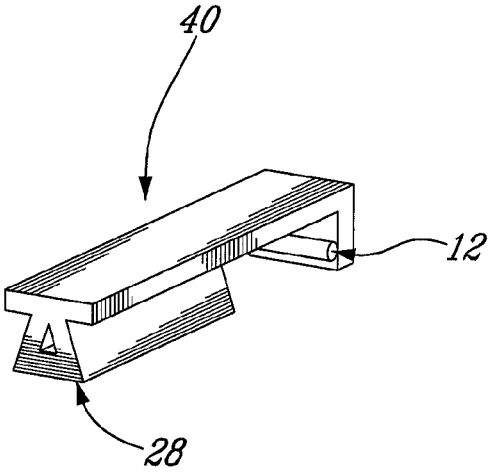
FIG. 12 is a three dimensional view of a cross member anchor.

FIG. 12 refers to a cross member fastener 40 defining on one side a shape 28 adapted to mate with the longitudinal retaining cavity 5 of the cross member 2 and defining on the opposite side a cross member anchor 12 adapted to engage the groove 6 of the runner 1. In the present example the dove tail 28 shaped side of the fastener 40 is inserted in the longitudinal retaining cavity 40 of a cross member 2 and the cross member 2 is positioned next to a runner 1 to insert the cross member anchor 12 in the slot of the runner 1 to secure the cross member 2 to the runner 1. The longitudinal extension 30 of the cross member 2 is adapted to rest on the lip 7 of the runner 1 to help transfer the load of the cross member 2 (and the panel 4 resting on the cross member) to the runner 1.

Figure 13:
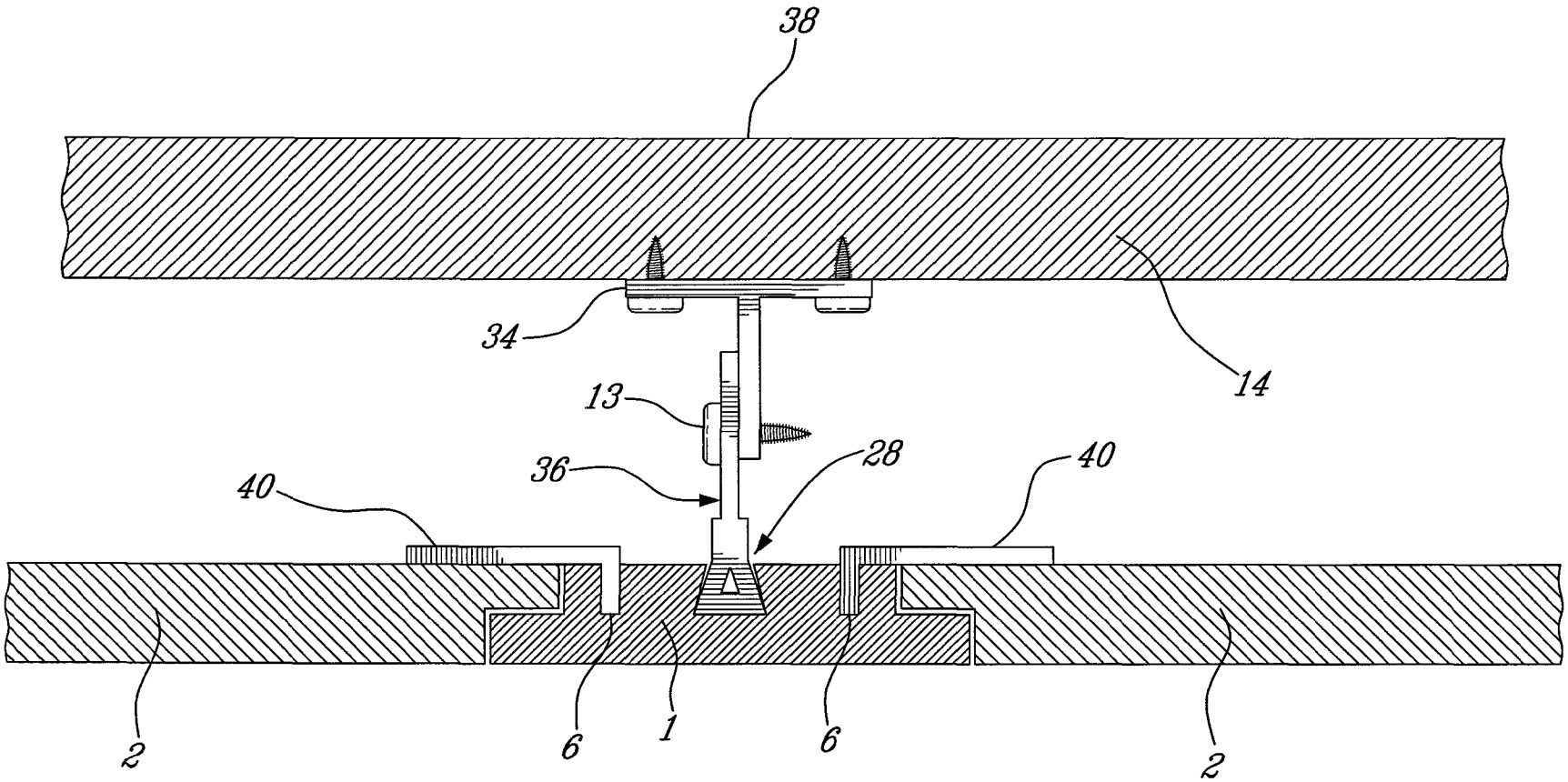
FIG. 13 is an overall view of the anchoring system that allows the runner and cross member to be secured to an overhead structure of the building.

FIG. 13 illustrates an assembly of two cross members 2 with an adjacent runner 1. It can be appreciated that each cross member 2 uses a cross member fastener 40 engaging both the longitudinal retaining cavities of the cross member 2 and the groove 6 of the runner 1. The runner 1 is hung to the above-ceiling structure 38 with the fastener 36 engaged on one side with the longitudinal retaining cavity 5 of the runner 1 and to the T-shaped support 40 on the other side.

Figure 14:
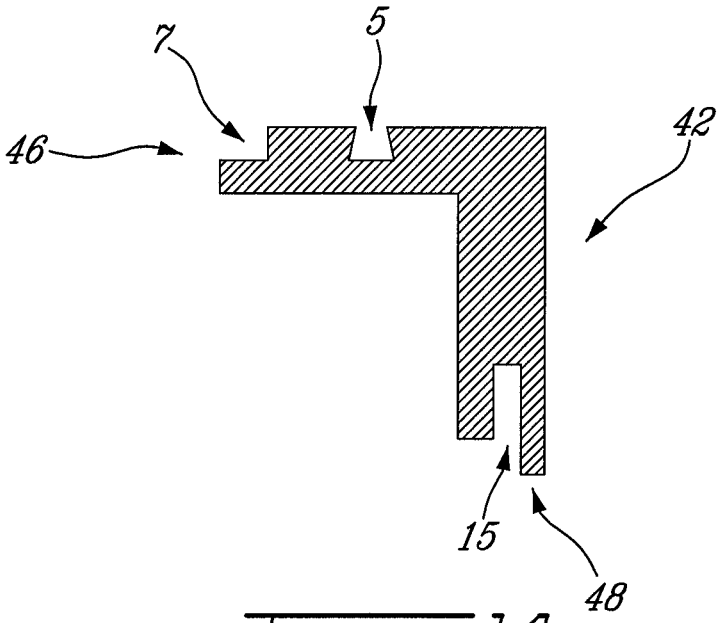
FIGS. 14 and 15 are cross sectional views of optional lower and upper runners adapted specifically to be used together for the addition of vertical panel.
Figure 15:
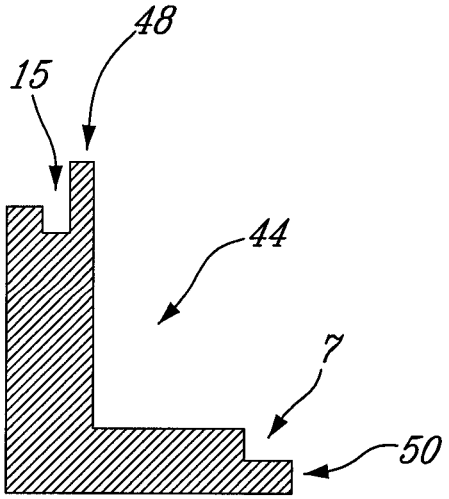

Turning now to FIG. 14 and FIG. 15 displaying respectively an upper runner 42 and a lower runner 44. The upper runner 42 and the lower runner 44 are generally used collectively to change the direction of the ceiling from the usual horizontal position 46 to a vertical position 48 and back to a horizontal position 50 in order to manage a change in height of the ceiling. The upper runner 42 provides, on a first side, a longitudinal retaining cavity 5 to secure the upper runner 42 and a lip 7 to receive a panel 4. In contrast the second side provides a groove 15 adapted to accommodate the panel 4. Similarly, the lower runner 44 provides, on a first side, a longitudinal retaining cavity 5 to secure the upper runner 42. The second side provides a groove 15 adapted to accommodate the panel 4. These runners 42, 44 can be suspended or directly secured to a beam or any suitable member using fasteners or glue.

Figure 16C:
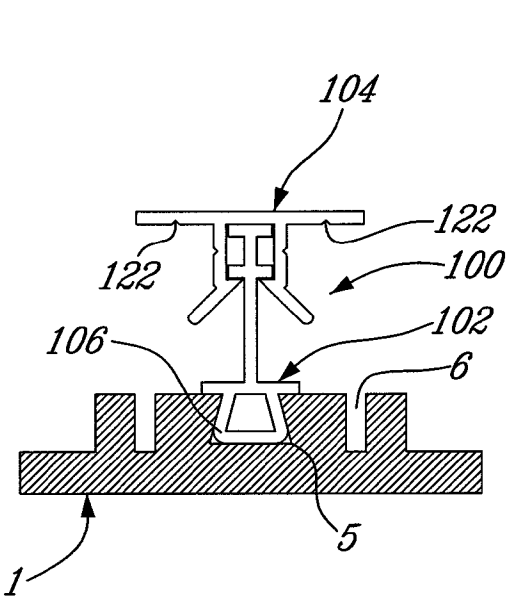
FIGS. 16*a*, 16*b* and 16*c* are sequential vertical cross sectional views of a clip assembly for attaching the main runners and/or the cross members to the ceiling, wherein the clip assembly includes a male member engaged in the dovetail groove of the runner/cross member and a female member adapted to be mounted to the ceiling and to be engaged to the male member.
Figure 16B:
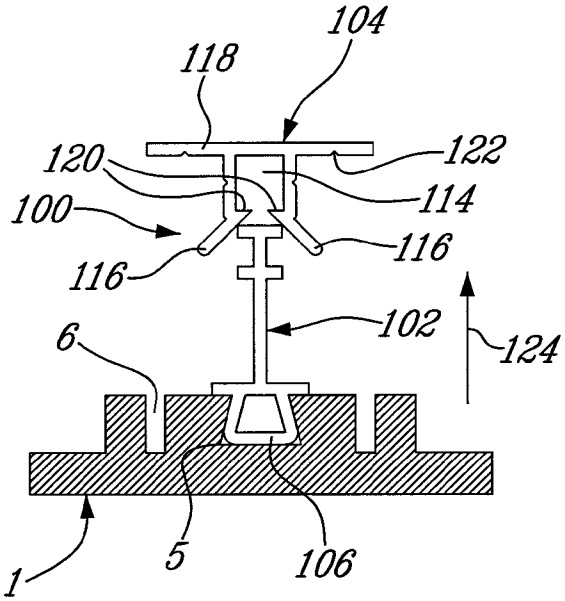
Figure 16A:
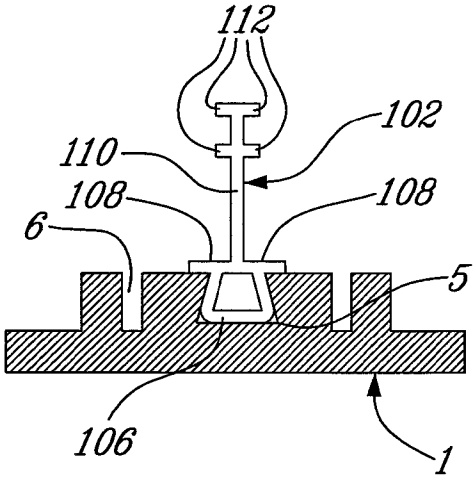
Figure 17:
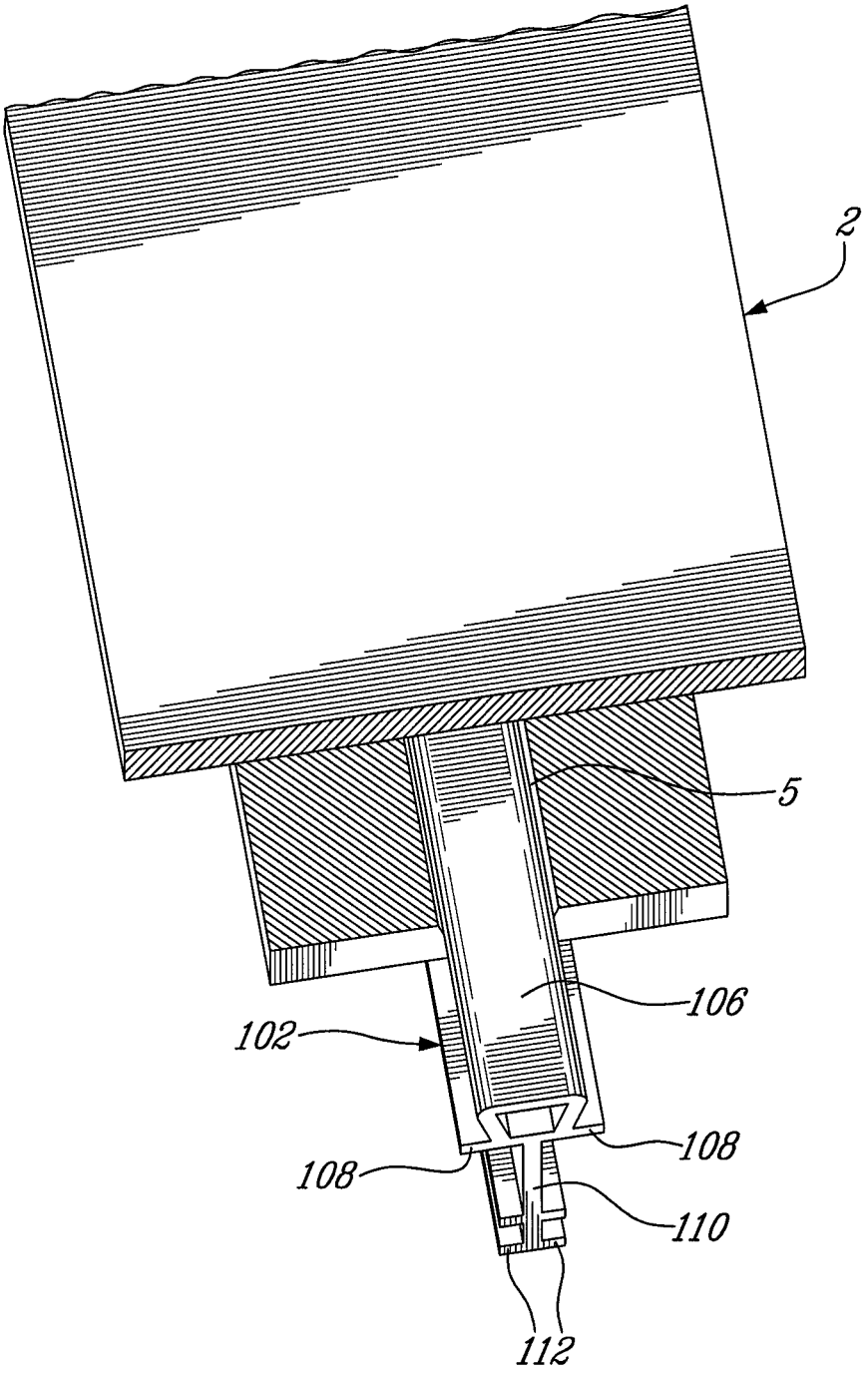
FIGS. 17 to 19 are respectively bottom perspective, bottom perspective and top perspective views of the male member of the clip assembly of FIG. 16 engaged in the cross member.
Figure 18:
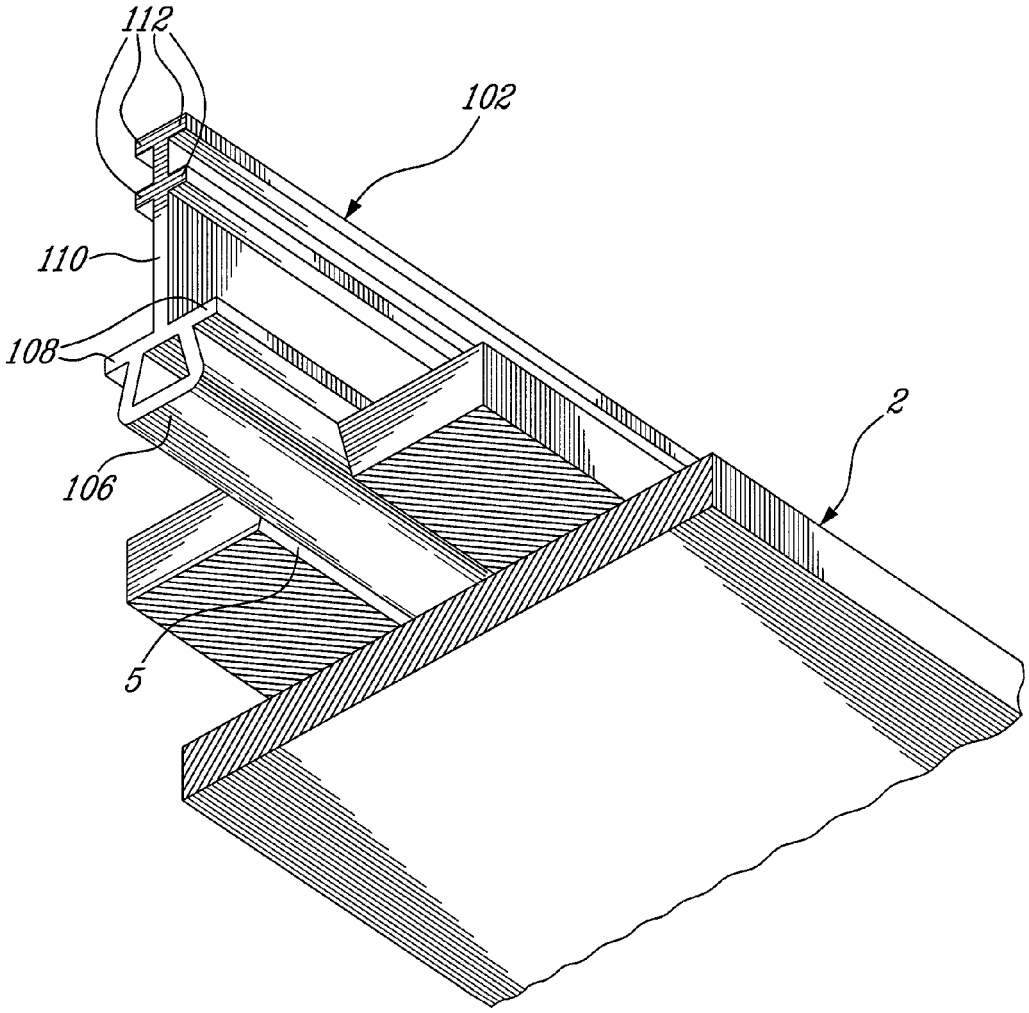
Figure 19:
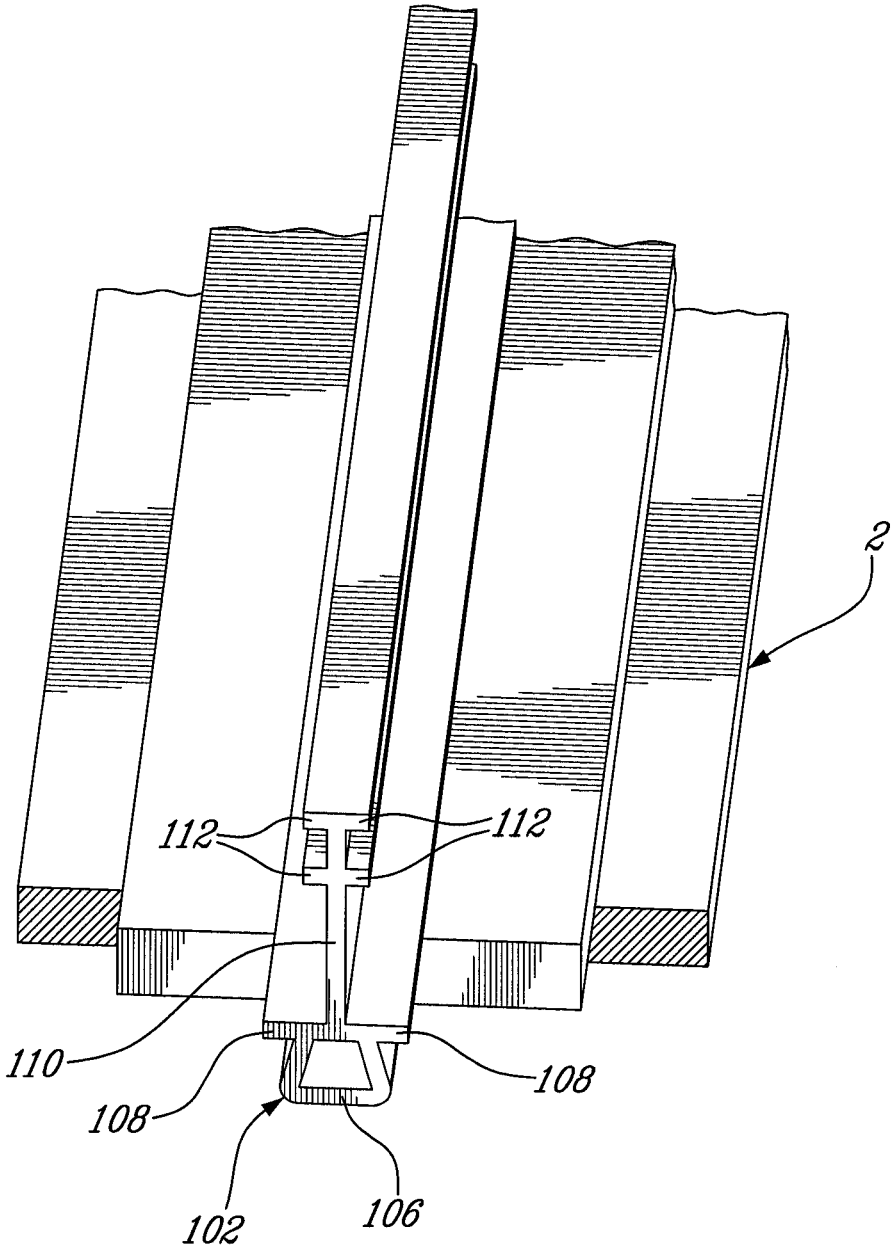
Figure 20:
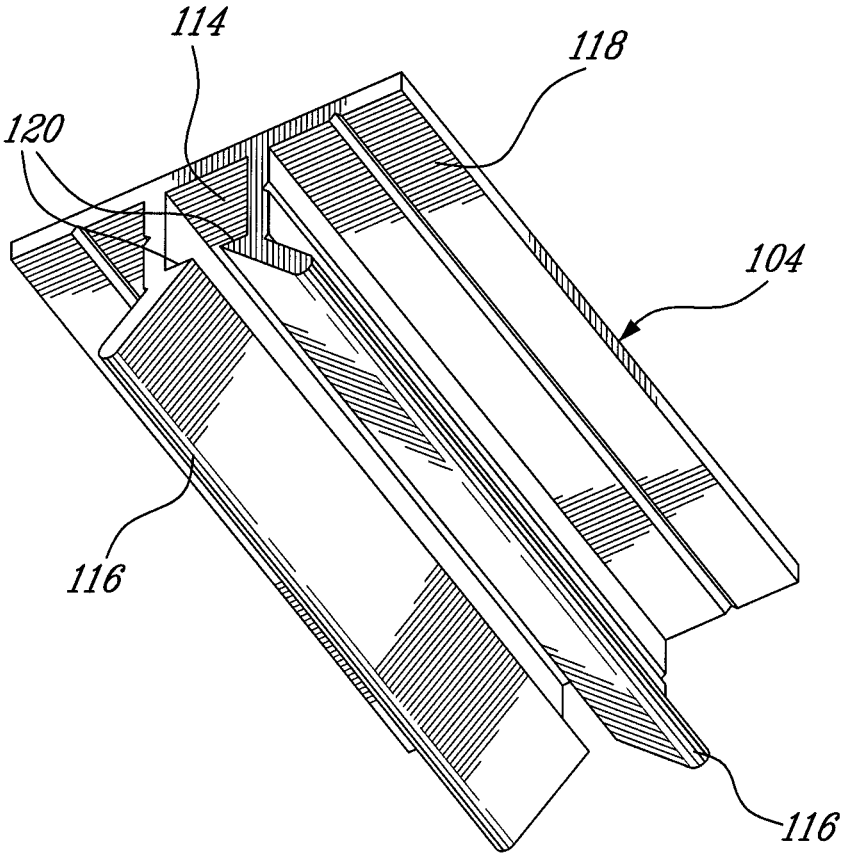
FIG. 20 is a bottom perspective view of the female member of the clip assembly of FIG. 16, shown in isolation.

With reference to FIGS. 16*a*, 16*b* and 16*c*, a clip assembly 100 is shown, the clip assembly including a male member 102 (shown in FIGS. 16*a*, 16*b* and 16*c*) and a female member 104 (shown in FIGS. 16*b* and 16*c*). The male member 102 includes a lower dove tail 106, side flanges 108, a vertical stem 110 and two sets of fins 112 corresponding to two different ceiling clearances. The female member 104 includes a channel 114, a pair of angled lower deflectors 116 and a horizontal upper plate 118, with shoulders 120 being provided where the deflectors 116 connect with the channel 114.

The dove tail 106 of the male member 102 is adapted to be engaged in the longitudinal retaining cavity 5 of the main runner 1, with the side flanges 108 overlying the upper surface 24 of the main runner 1 (FIG. 16*a*). The female member 104 is (typically in residential applications where there are overhead studs, beams or other structural supports) adapted to be attached to the ceiling by way of screws (not shown) upwardly driven through the upper plate 118 and typically at notches 122 defined in the upper plate 118 (FIG. 16*b*).

Still referring to FIG. 16*b*, the main runner 1 carrying the male member 102 is translationnally moved upwardly (along arrow 124) towards the female member 104 (which is fixed to the ceiling by way of the aforementioned screws) such that the set of fins 112 of the male member 102 corresponding to the desired ceiling clearance engage the lower deflectors 116 of the female member 104 thereby causing the same to spread until the upper end of the male member 102 including the set of fins 112 thereof become lodged in the channel 114. As seen in FIG. 16*c*, the lower deflectors 116 then return to their inward position, whereby the lower set of fins 112 lies atop the shoulders 102 thereby retaining the male member 102, in a suspended state, to the female member 104. It is to be understood that the male member 102 may include one or a plurality of sets of fins 112 depending on the provided ceiling clearances. The mating parts of the male and female members 102 and 104 are typically designed to be disengageable from one another if sufficient force (greater than the suspended weight of the suspended ceiling) is downwardly applied to the male member 102.

It is noted that the clip assembly 100 only requires about 1.25 inch of clearance. Therefore, a suspended ceiling can be mounted directly to an existing finished ceiling without significantly reducing the useful height of the room.

Generally, the female member 104 is not used in commercial applications, since in such applications the suspended ceiling is held with metal wiring, as opposed to residential applications where screws are used to attach the female member 104 directly to a structural component of the ceiling.

Figure 21:
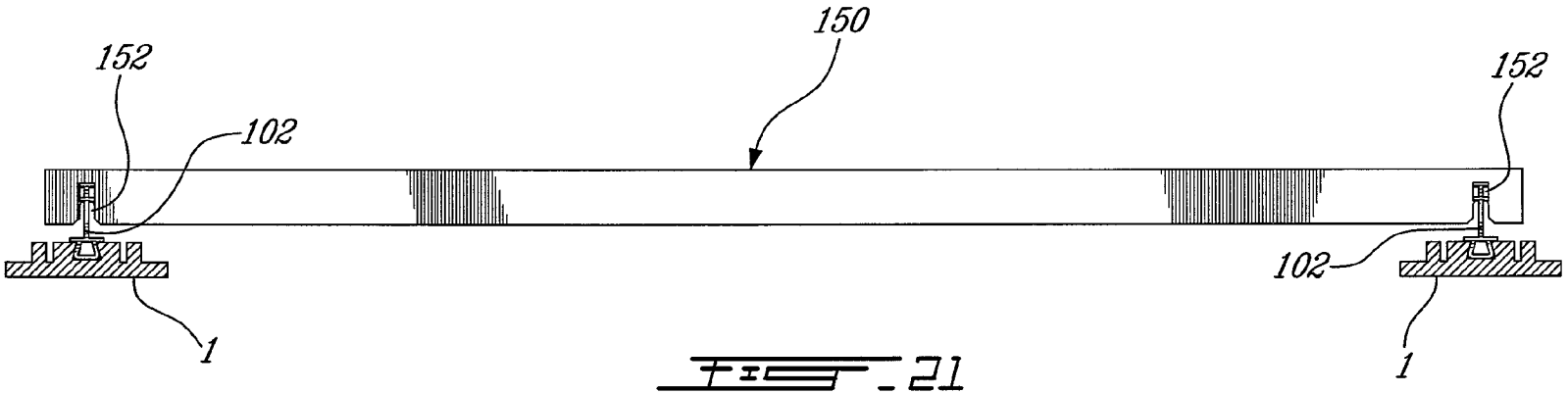
FIG. 21 is a vertical cross sectional view of a pair of main runners, male members of the clip assembly of FIG. 16 being engaged in each main runner, with the male members of the two main runners being connected by a transversal stabilizing bar.
Figure 22:
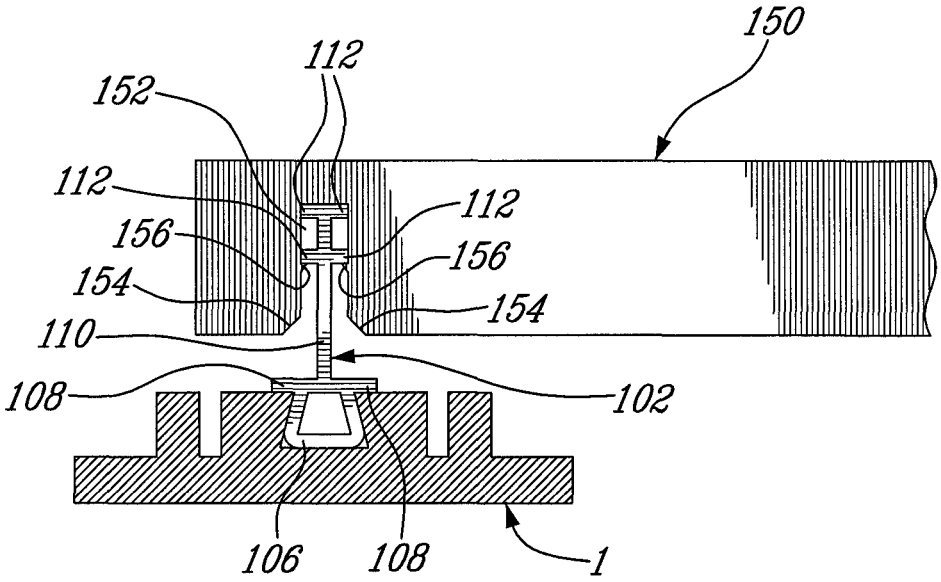
FIG. 22 is an enlarged view of one of the main runners of FIG. 21, of its associated male member and of part of the stabilizing bar.

Now referring to FIG. 21, the male member 102 of the clip assembly 100 is also used as follows, typically in commercial applications. As the suspended ceiling is attached to the hidden structure with wiring in commercial applications, stabilizing bars 150 are used, in a spaced apart arrangement, to connect adjacent main runners 1. More particularly, as best seen in FIG. 22, the stabilizing bar 150 defines at each end thereof a channel 152 having a lower flared end 154 and intermediate inwardly-projecting shoulders 156.

The stabilizing bar 150 and the main runners 1 carrying the male members 102 are brought together such that the male members 102 become lodged in the channels 152, the male members 102 being retained therein by their lower set of fins 112 overlying the shoulders 156 of the stabilizing bar 150. The stabilizing bar 150 thus prevents dangling of the main runners 1. The mating parts of the male member 102 and the stabilizing bar 150 are typically designed to be disengageable from one another if sufficient force is applied.

Figure 23:
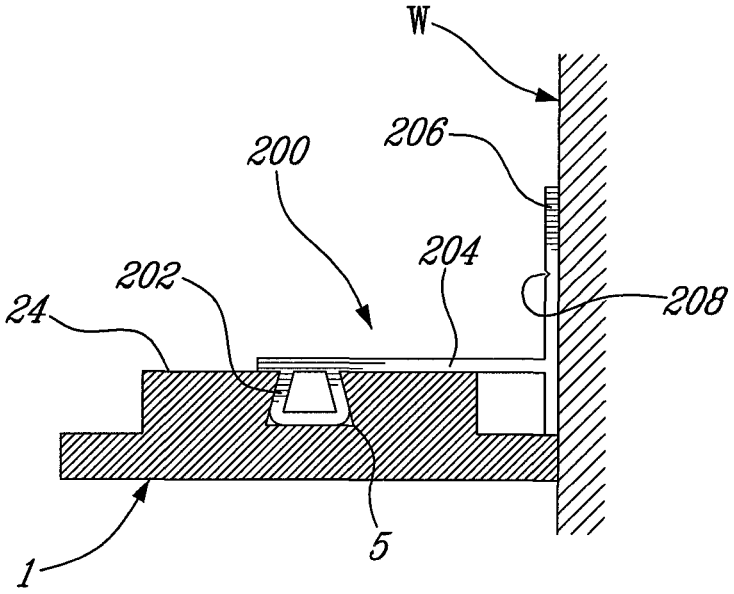
FIG. 23 is a vertical cross sectional view of a wall fastener for securing main runners to walls.

FIG. 23 illustrates a wall fastener 200 for securing the end main runners 1 to their respective adjacent walls W. The fastener 200 includes a dove tail 202, a horizontal plate 204, and a vertical plate 206. The dove tail 202 engages the longitudinal retaining cavity 5 of the main runner 1, with the horizontal plate 204 overlying the upper surface 24 of the main runner 1. The vertical plate 206 is secured to the wall W via screws (not shown) driven through the vertical plate 206 and typically at notches 208 defined in the vertical plate 206.

Figure 24:
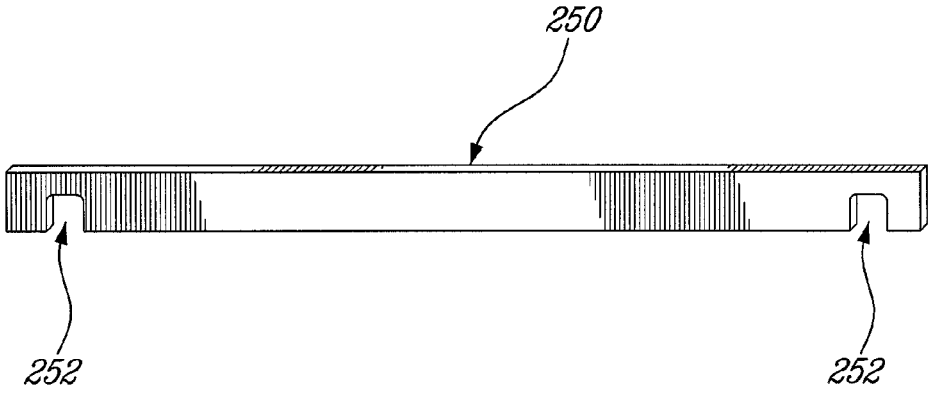
FIG. 24 is a side view of an clip assembly spacing gauge.
Figure 25:
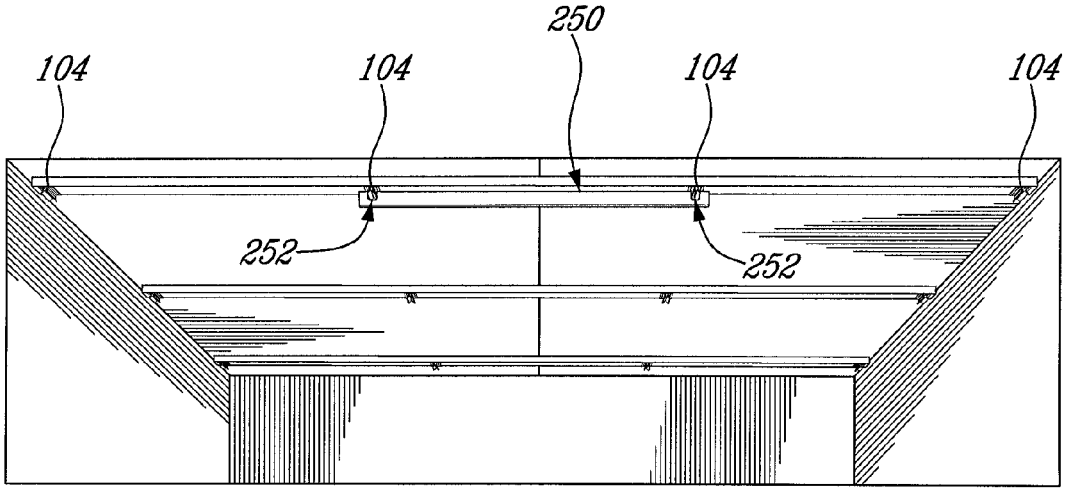
FIG. 25 is a bottom perspective view of the clip assembly spacing gauge of FIG. 24 used to space clip assemblies apart.

Now referring to FIGS. 24 and 25, a clip assembly spacing gauge 250 may be used in order to position female members 104 in parallel at a constant desired spacing, for example 26 inches from center to center. The gauge 250 defines at each end thereof a channel 252 adapted to receive the female members 104 so as to properly space them apart along a structural component of the ceiling. It is to be understood that the dimensions of the gauge 250 may vary depending on the desired spacing between the female members 104 and the type of female members used. The channels may also be adapted to receive other types of clip assemblies. In an alternative embodiment, the gauge 250 may be adapted so as to vary is length in order to provide a plurality of desired spacing.

Although the present invention has been described hereinabove by way of embodiments thereof, it may be modified, without departing from the nature and teachings of the subject invention as described herein.

What is claimed is:

1. A suspended ceiling comprising:

at least two main runners for being adjacently spaced apart and removably secured to an overhead structural member without being fastened thereto, each of the main runners defining a length thereof and comprising a groove along the respective length thereof;

at least two clip assemblies, each clip assembly securing a respective one of the runners to the overhead structure, each of the clip assemblies having a respective longitudinal length that is lesser than the longitudinal length of their respective runner, thereby providing for positioning each clip assembly at a selectively desired position along the length of their respective runner, each clip assembly comprising assembled first and second members, the first and second members are independent longitudinal single and monolithic rigid members devoid of any fasteners therebetween, the second member being slidably engaged to the first member and slidably and removably engaged to a respective one of the runners;

the first member of the clip assembly comprises:

a top portion having a hole for being fastened to the overhead structure, the top portion defining an inner flat surface;

a pair of spaced apart arms downwardly extending from the top portion, the inner flat surface and the spaced apart arms defining a downwardly facing channel therebetween, each of the spaced apart arms comprising a respective vertical upper section defining an upper channel section and a respective lower section outwardly and diagonally extending relative to the upper vertical section defining a lower channel section, the upper channel section being narrower than the lower channel section;

the second member of the clip assembly comprises:

a bottom portion adapted to be slidingly and removably fitted within the groove of a given one of the runners groove devoid of any fasteners therebetween thereby allowing selective slidable position adjustment of the clip assembly along the length of the runner groove;

a top portion defining a protrusion including at least two spaced apart sets of fins adapted for selective vertical adjustment of the relative assembled position of the first and second members, the protrusion comprises an elongated stem defining opposite lateral sides, each of the fins comprises a pair of arms respectively extending from a respective one of the lateral sides, each arm being perpendicular relative to the stem and defining top and bottom flat surfaces and a flat free end lateral surface, the protrusion comprising a top surface, the protrusion being adapted to be inserted into the first member end to be slidingly positioned therein or to be guided within the channel via the spaced apart arms, the two spaced apart fins being releasably connectable to the first member within the upper channel section and being adapted for selective vertical adjustment of the relative assembled position of the first and second members, the top surface of the protrusion providing for engaging the inner flat surface of the first member, at least a pair of cross members for being adjacently spaced apart and having flat mounting surfaces devoid of any fasteners to be removably disposed and positioned on the at least two main runners in an unfastened relationship therewith in a lattice pattern forming an opening, thereby providing for the cross member not to be fastened to the runners in order to be selectively and manually removed, repositioned and replaced;

at least one ceiling panel in the form of a monolithic single piece and comprising opposite lateral edges and opposite longitudinal end edges, the panel being removably positioned within the opening on the at least two main runners with each of the lateral edges having flat mounting surfaces devoid of any fasteners to be removably positioned on a respective one of the main runners in an unfastened relationship therewith, the main runners having respective flat panel edge receiving surfaces devoid of any fasteners, the longitudinal end edges having flat mounting surfaces devoid of any fasteners and being removably positioned on the at least two cross members in an unfastened relationship therewith, the cross members having respective flat panel edge receiving surfaces devoid of any fasteners, thereby providing for the panel to be selectively lifted by manual inward pushing thereof in order to access the overhead structure;

wherein, assembly of the first and second members of each of the clip assemblies provides for the at least two runners to be suspended from the overhead structure and to support the panel thereon and therebetween, thereby providing for the ceiling panels to not be fastened to the runners and to provide selective manual removal and replacement thereof.

2. The suspended ceiling of claim 1, wherein the first member includes a pair of shoulders provided at a junction of the spaced apart arms and the upper channel section, the fins being adapted to selectively engage the shoulders.

3. The suspended ceiling of claim 1, wherein the second member includes a dove tail adapted to slidingly engage the groove of the given one of the runners.

4. The suspended ceiling of claim 1, wherein the second member includes side flanges above the bottom portion that directly and snuggly overlay an upper surface of the given one of the runners when the bottom portion is within the groove of the given one of the runners.

* * * * *